US011712147B2

(12) United States Patent
Potluru et al.

(10) Patent No.: US 11,712,147 B2
(45) Date of Patent: Aug. 1, 2023

(54) RACK MOUNTING FEATURES FOR A DISHWASHER APPLIANCE

(71) Applicant: Haier US Appliance Solutions, Inc., Wilmington, DE (US)

(72) Inventors: Santhosh Kumar Potluru, Hyderabad (IN); Arpit Singhal, Uttar Pradesh (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 260 days.

(21) Appl. No.: 17/108,466

(22) Filed: Dec. 1, 2020

(65) Prior Publication Data

US 2022/0167827 A1 Jun. 2, 2022

(51) Int. Cl.

| | |
|---|---|
| ***A47L 15/50*** | (2006.01) |
| ***A47L 15/42*** | (2006.01) |
| ***A47L 15/22*** | (2006.01) |

(52) U.S. Cl.

CPC ..... *A47L 15/50* (2013.01); *A47L 15/22* (2013.01); *A47L 15/4246* (2013.01)

(58) Field of Classification Search

CPC ..... A47L 15/22; A47L 15/50; A47L 15/4246
See application file for complete search history.

(56) References Cited

U.S. PATENT DOCUMENTS

| | | | | |
|---|---|---|---|---|
| 3,804,483 | A | 4/1974 | Afful et al. | |
| 3,834,784 | A * | 9/1974 | Butsch | A47L 15/4246 312/351.3 |
| 4,359,250 | A * | 11/1982 | Jenkins | A47L 15/4246 312/351.4 |
| 4,402,556 | A | 9/1983 | Schwing | |
| 5,730,301 | A | 3/1998 | Johnson | |
| 9,579,010 | B2 | 2/2017 | Shewmaker | |
| 2006/0250058 | A1* | 11/2006 | Stevens | A47L 15/507 312/311 |
| 2014/0145573 | A1* | 5/2014 | Cox | A47L 15/507 312/228.1 |
| 2015/0190033 | A1* | 7/2015 | Shaffer | A47L 15/507 312/228.1 |
| 2019/0365197 | A1 | 12/2019 | Maddux | |
| 2020/0154976 | A1* | 5/2020 | Kim | A47L 15/507 |

FOREIGN PATENT DOCUMENTS

| | | |
|---|---|---|
| EP | 1323548 A2 | 7/2003 |

* cited by examiner

*Primary Examiner* — James O Hansen
(74) *Attorney, Agent, or Firm* — Dority & Manning, P.A.

(57) ABSTRACT

A rack mounting assembly for supporting a third rack assembly within a tub of a dishwasher appliance is provided. The rack mounting assembly includes a mounting body positioned inside the wash chamber and having a mounting post and a support flange extending from the mounting body and being spaced apart to define a support slot. A roller includes a mounting sleeve having a rear lip that is received within the support slot when the roller is installed onto the mounting body.

20 Claims, 11 Drawing Sheets

RACK MOUNTING FEATURES FOR A DISHWASHER APPLIANCE

FIELD OF THE INVENTION

The present disclosure relates generally to dishwasher appliances, and more particularly to improved rack mounting features for dishwasher appliances.

BACKGROUND OF THE INVENTION

Dishwasher appliances generally include a tub that defines a wash chamber. Rack assemblies can be mounted within the wash chamber of the tub for receipt of articles for washing. Multiple spray assemblies can be positioned within the wash chamber for applying or directing wash fluid towards articles disposed within the rack assemblies in order to clean such articles. Dishwasher appliances are also typically equipped with at least one pump for circulating fluid through the multiple spray assemblies. In addition, devices referred to as diverters may be used to control the flow of fluid received from the pump.

In addition to conventional lower and middle rack assemblies, certain dishwasher appliances include a "third rack" or "upper rack" positioned above the lower and middle rack assemblies, e.g., for receiving flatware, cutlery, or other cooking utensils. For both conventional third rack assemblies, properly supporting such rack assemblies within the tub of the dishwasher appliance requires the installation of a mounting bracket or assembly. These mounting brackets commonly include a small post or stud that extends horizontally into the wash chamber for receiving a roller that engages a slide assembly. However, these studs typically support the full load of the third rack and any utensil placed thereon, and are therefore often prone to premature degradation, malfunction, breakage, or other failures.

Accordingly, a dishwasher appliance that utilizes improved rack mounting features would be useful. More specifically, a rack mounting assembly that facilitates improved load support while reducing the likelihood of failure would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a dishwasher appliance defining a vertical, a lateral, and a transverse direction is provided. The dishwasher appliance includes a tub defining a wash chamber for receipt of articles for washing, a third rack assembly slidably positioned within the wash chamber and configured for movement along the transverse direction, and a rack mounting assembly for supporting the third rack assembly. The rack mounting assembly includes a mounting body positioned inside the wash chamber and being secured to the tub, a mounting post extending from the mounting body, a support flange extending from the mounting body and being spaced apart from the mounting post to define a support slot, and a roller comprising a mounting sleeve defining a central aperture and a rear lip, the rear lip being received within the support slot when the roller is installed onto the mounting body.

In another exemplary embodiment, a rack mounting assembly for supporting a third rack assembly within a tub of a dishwasher appliance is provided. The tub defines a wash chamber for receipt of articles for washing and a plurality of apertures. The rack mounting assembly includes a mounting body positioned inside the wash chamber and being secured to the tub, a mounting post extending from the mounting body, a support flange extending from the mounting body and being spaced apart from the mounting post to define a support slot, and a roller comprising a mounting sleeve defining a central aperture and a rear lip, the rear lip being received within the support slot when the roller is installed onto the mounting body.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
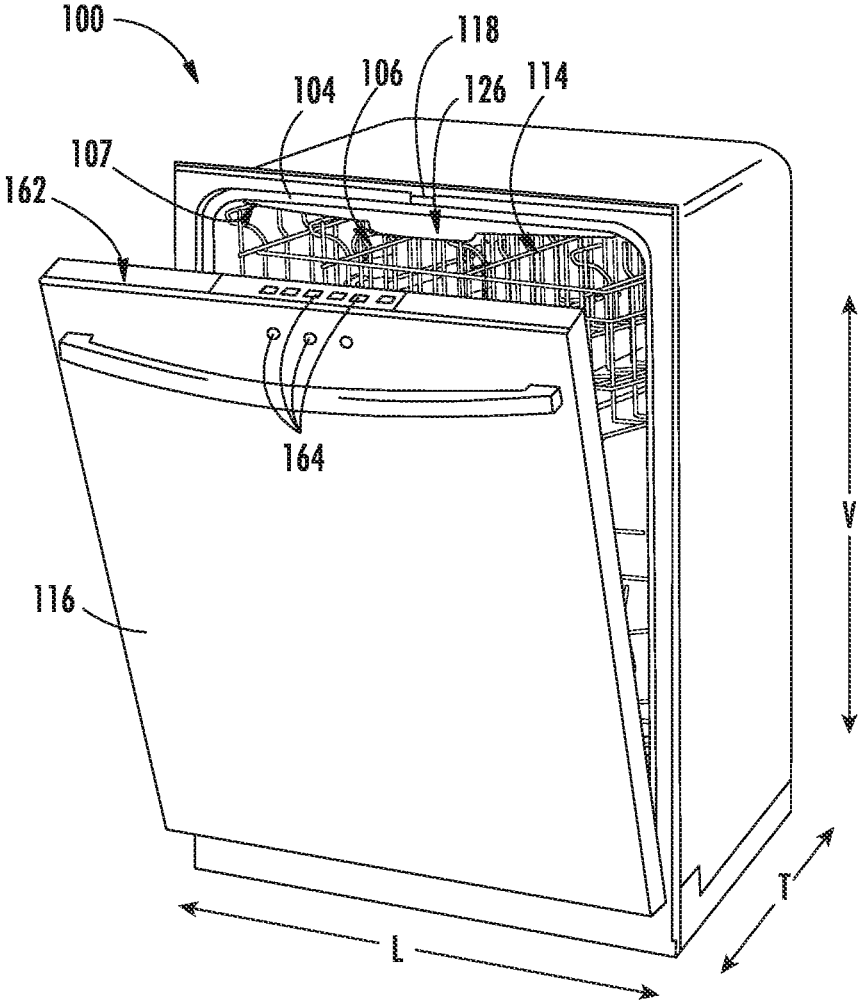
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments.

Figure 2:
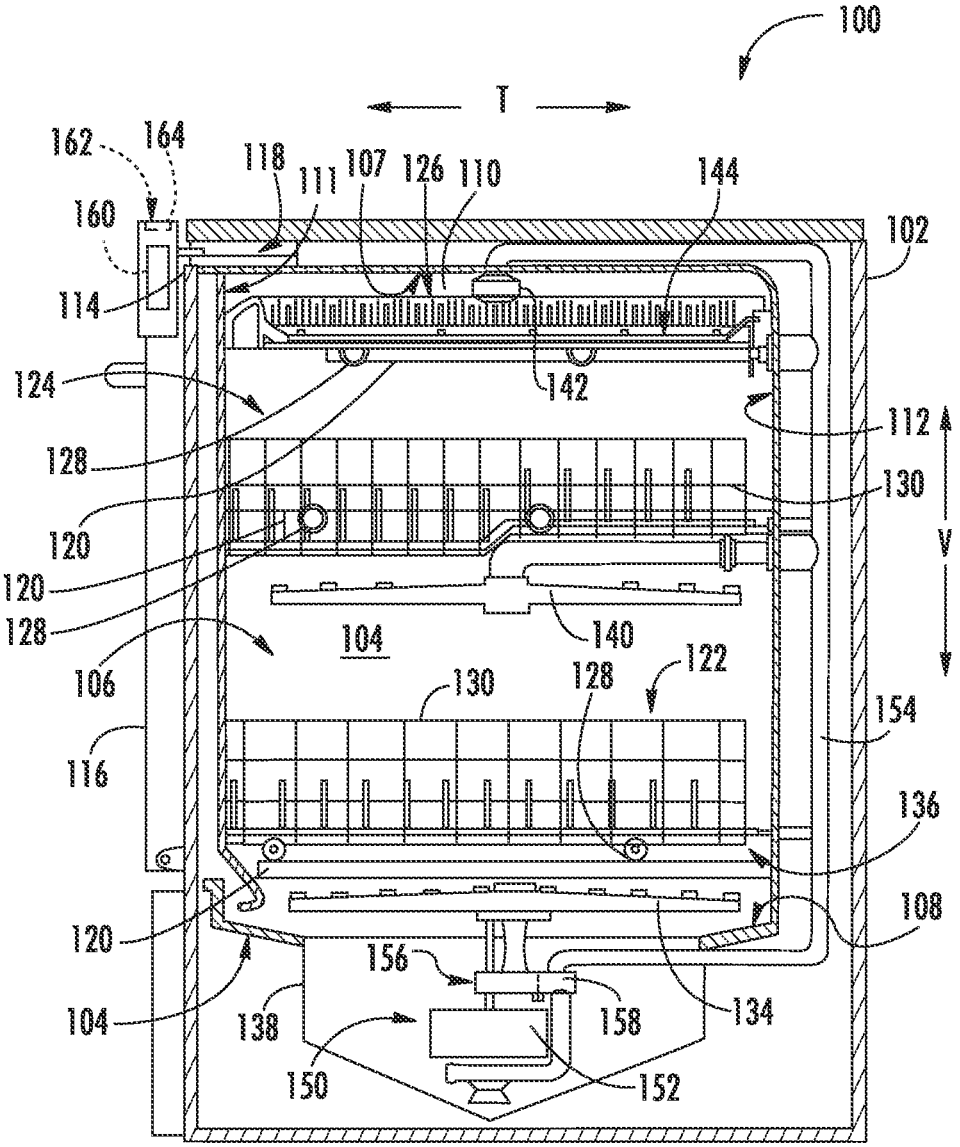
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, guide rails 120 may be mounted to side walls 110 for supporting a lower rack assembly 122, a middle rack assembly 124, and a third rack assembly 126. As illustrated, third rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and third rack assembly 126. Additionally, an upper spray assembly 142 may be located above third rack assembly 126 along the vertical direction V. In this manner, upper spray assembly 142 may be configured for urging and/or cascading a flow of wash fluid downward over rack assemblies 122, 124, and 126. As further illustrated in FIG. 2, third rack assembly 126 may further define an integral spray manifold 144, which is generally configured for urging a flow of wash fluid substantially upward along the vertical direction V through third rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level and/or upper spray assemblies 140, 142, i.e., such as primary supply conduit 154.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Figure 3:
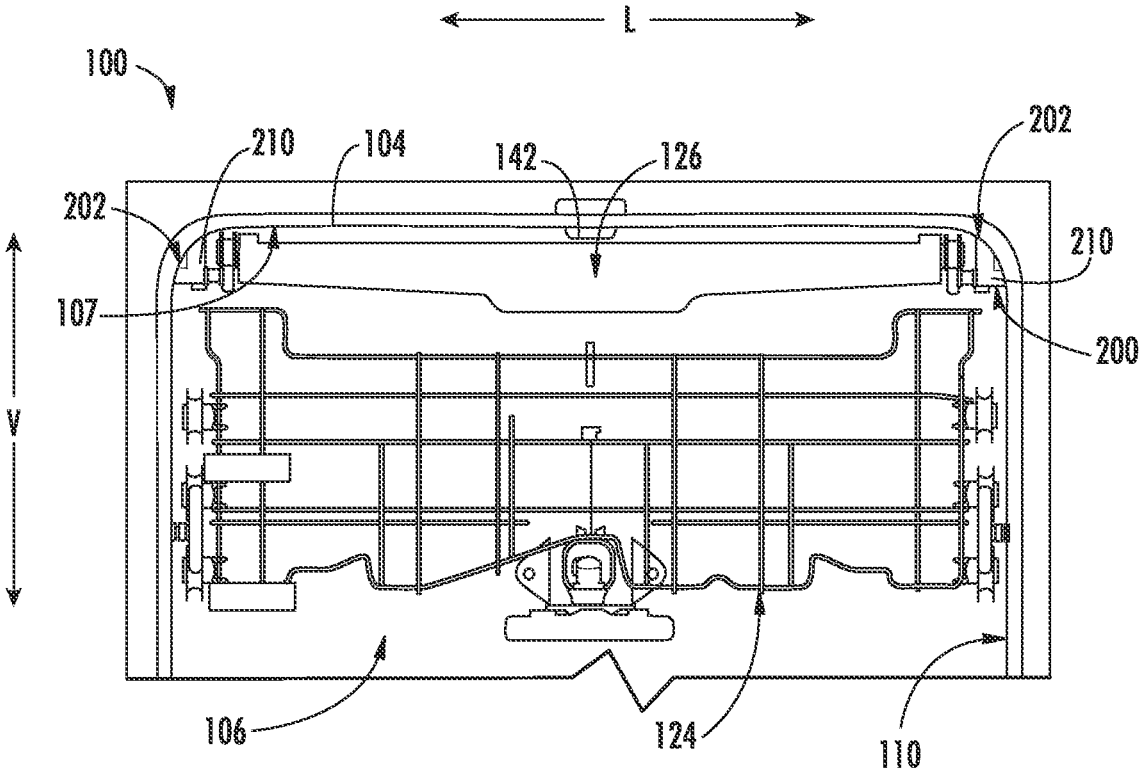
FIG. 3 provides a front view of a third rack assembly of the exemplary dishwashing appliance of FIG. 1 according to an exemplary embodiment of the present subject matter.
Figure 4:
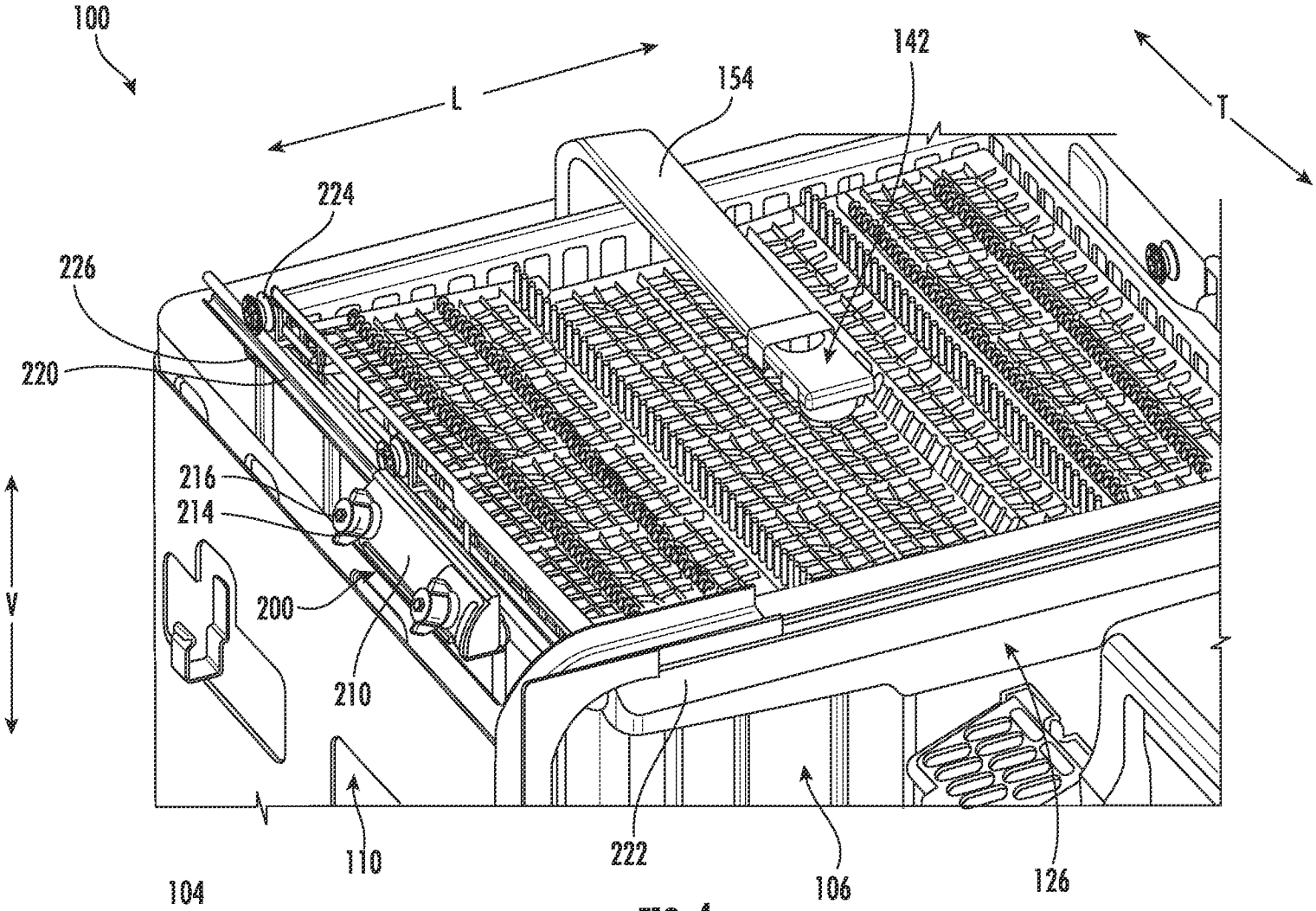
FIG. 4 provides a perspective view of the exemplary dishwashing appliance of FIG. 1 with a portion of a tub removed to reveal the exemplary third rack assembly of FIG. 3 according to an example embodiment of the present subject matter.
Figure 5:
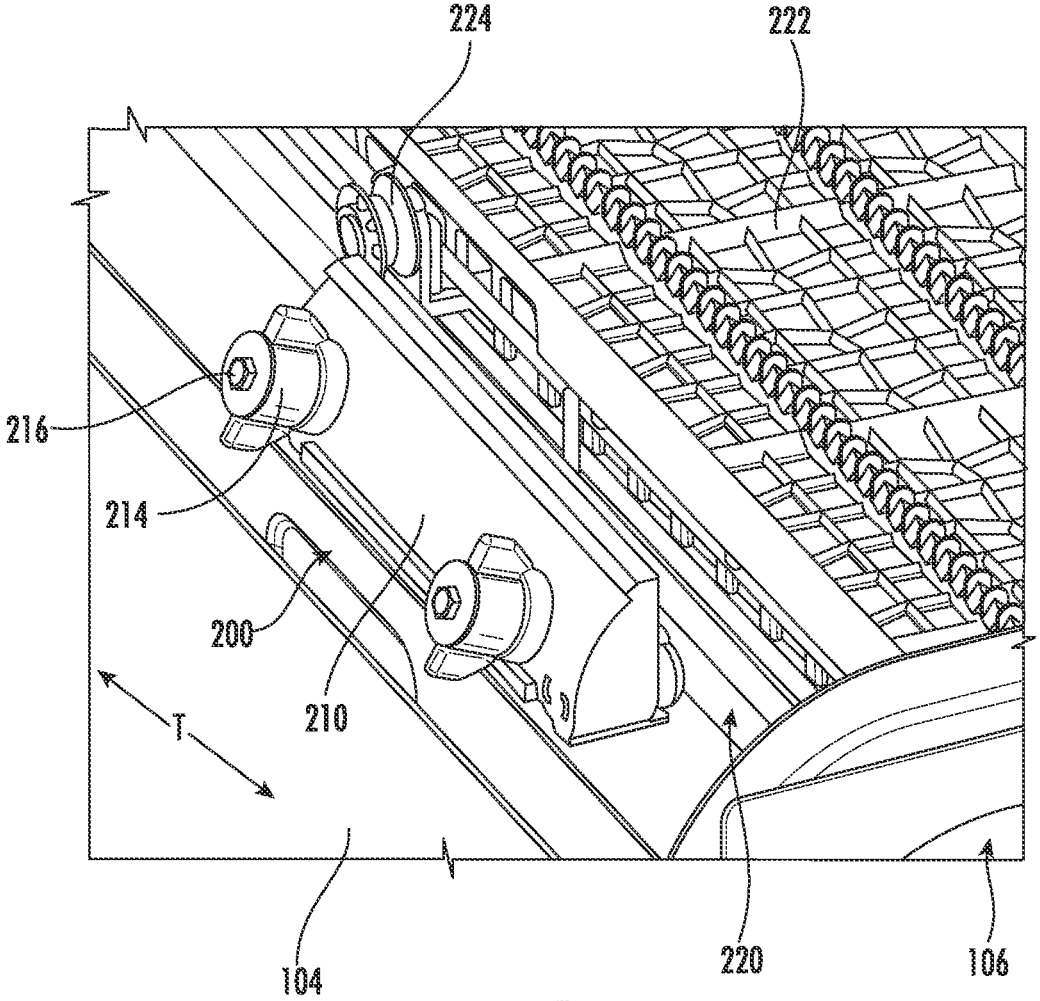
FIG. 5 provides a close-up, perspective view of a rack mounting assembly of FIG. 3 with a portion of the tub removed for clarity according to an example embodiment of the present subject matter.
Figure 6:
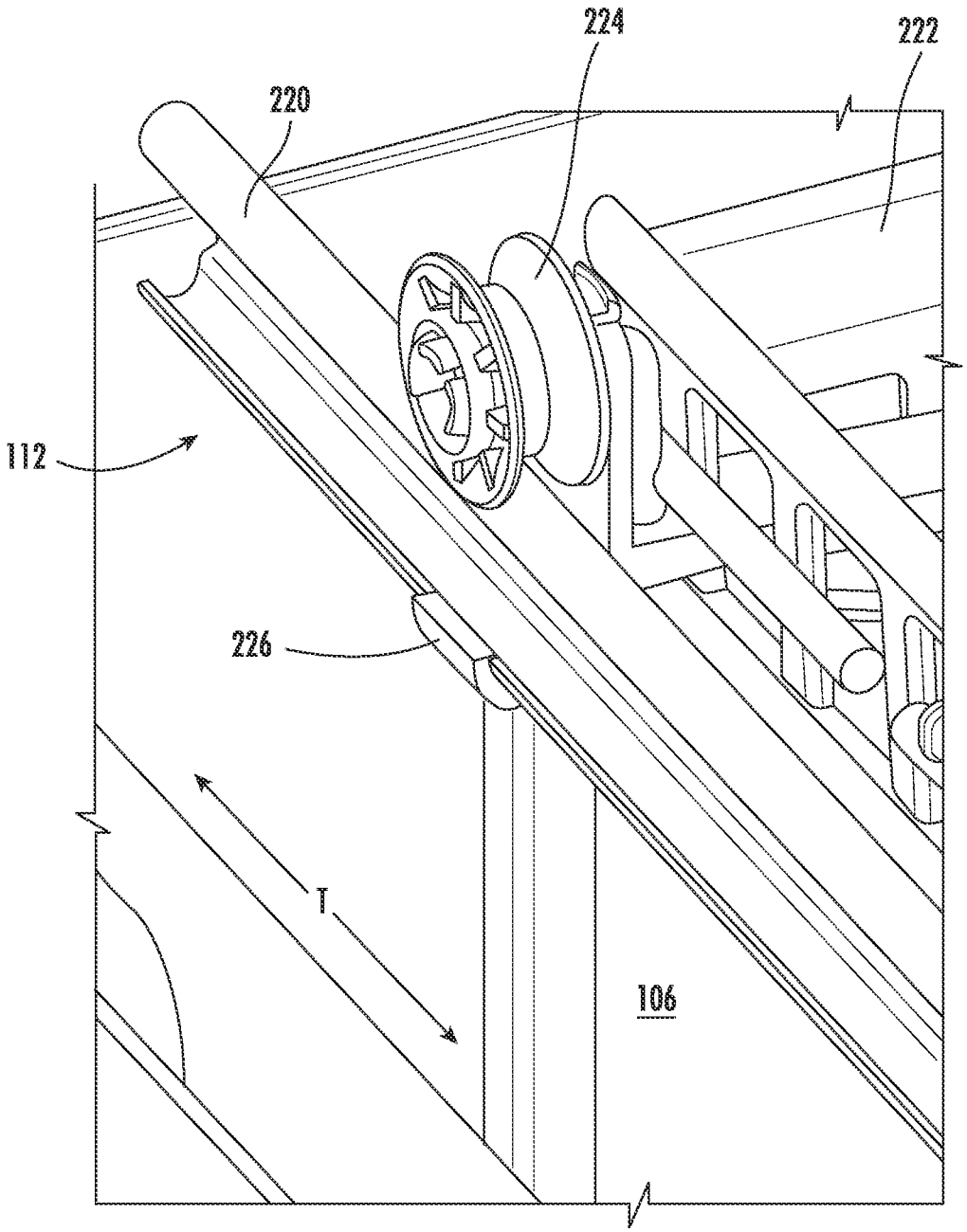
FIG. 6 provides a perspective view of a rack roller engaging a slide assembly according to an exemplary embodiment of the present subject matter.
Figure 7:
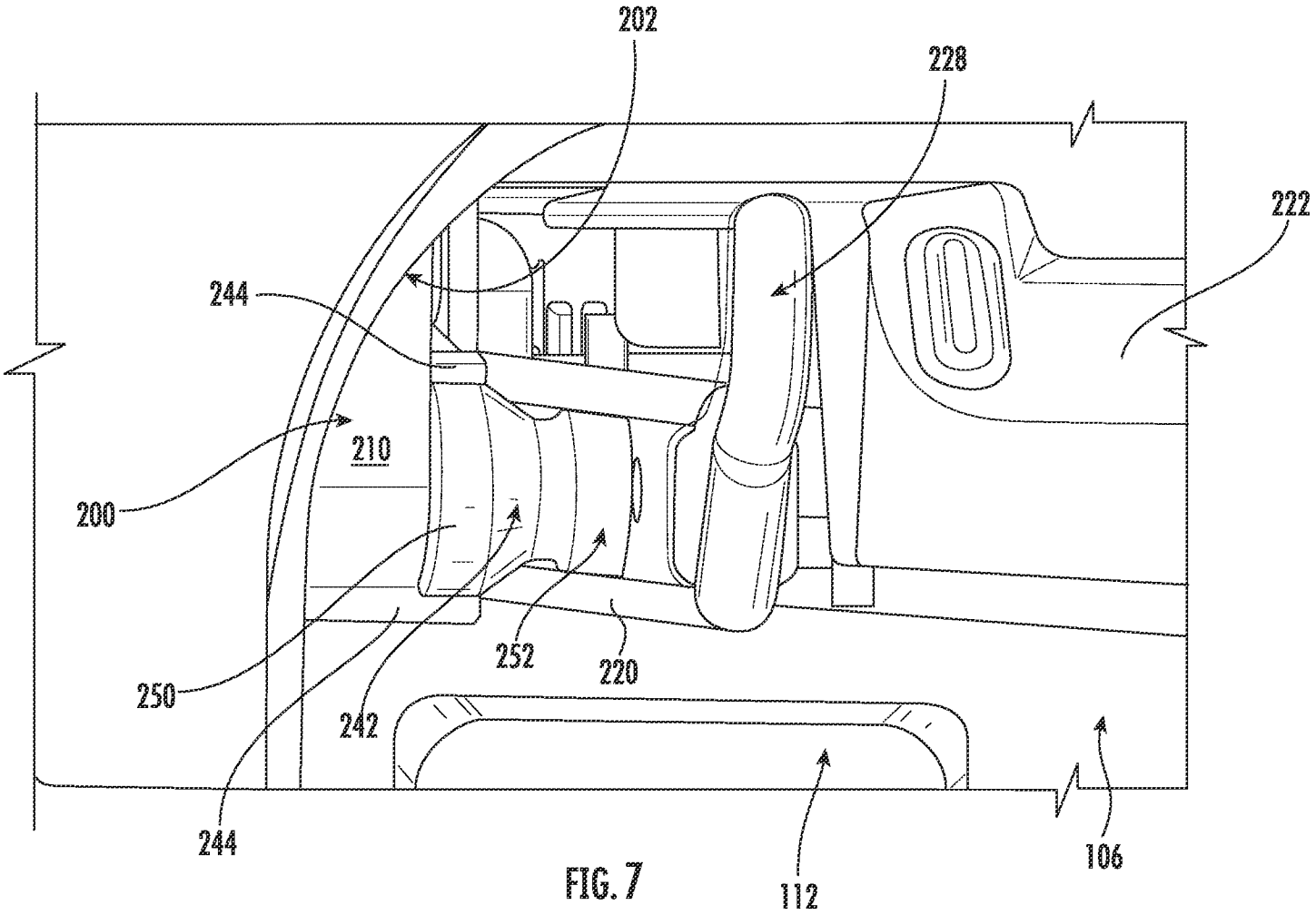
FIG. 7 provides a perspective view of the exemplary rack mounting assembly of FIG. 3 supporting a slide assembly according to an exemplary embodiment of the present subject matter.
Figure 8:
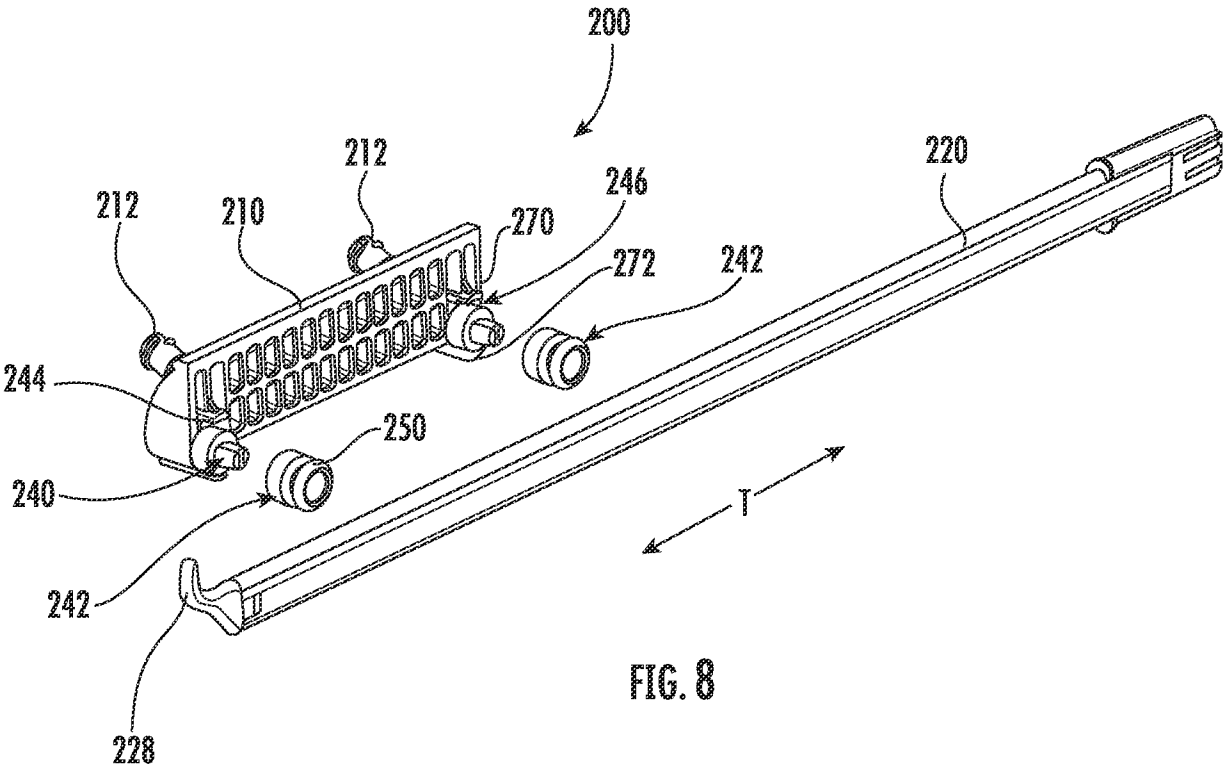
FIG. 8 provides an exploded view of the exemplary rack mounting assembly of FIG. 3 and the exemplary slide assembly of FIG. 7 according to an exemplary embodiment of the present subject matter.

Referring now generally to FIGS. 2 and 3, a rack mounting assembly 200 for mounting third rack assembly 126 to tub 104 will be described according to an exemplary embodiment of the present subject matter. According to the illustrated embodiment, dishwasher appliance 100 includes two rack mounting assemblies 200 positioned within wash chamber 106 and mounted to tub 104 for supporting third rack assembly 126. However, it should be appreciated that aspects of the present subject matter may be used to support any suitable rack assembly in any suitable appliance. For example, mounting assemblies 200 or aspects thereof may be used to support lower rack assembly 122, middle rack assembly 124, or a rack of any other suitable appliance, such as a refrigerator or oven appliance. According to exemplary embodiments of the present subject matter, the two rack mounting assemblies include pieces that are identical and interchangeable.

As best illustrated in FIG. 3, dishwasher appliance 100 includes two rack mounting assemblies 200 positioned at the top corners of tub 104. More specifically, tub 104 defines radiused corners 202 where top wall 107 and the left and right side walls 110 meet. Radiused corners 202 are frequently used in dishwasher appliance tubs to simplify the formation process and improve the structural rigidity of tub 104. According to exemplary embodiments of the present subject matter, tub 104 is formed from stainless steel or any other suitably rigid material. According to still other embodiments, tub 104 may be injection-molded using any suitable plastic material.

Referring now also to FIGS. 4 through 7, rack mounting assembly 200 will be generally described according to an exemplary embodiment. As illustrated, rack mounting assembly 200 generally includes a mounting body 210 that is positioned inside wash chamber 106. In general, mounting body 210 may be any suitable structure positioned within wash chamber 106 and mounted in any suitable manner for supporting third rack assembly 126. For example, according to the illustrated embodiment, mounting body 210 defines one or more mounting bosses 212 that are positioned through apertures (not shown) defined in tub 104. One or more mechanical fasteners may be received within mounting bosses 212 to secure mounting body 210 firmly against tub 104. Specifically, according to the illustrated embodiment shown in FIGS. 4 and 5 (where a portion of tub 104 is removed for clarity), these mechanical fasteners may include a wingnut 214 and a separate screw 216 that is driven into each mounting boss 212 to secure mounting body 210. It should be appreciated that according to other embodiments, mounting body 210 may be secured to tub 104 in any other suitable manner while remaining within the scope of the present subject matter.

In general, mounting body 210 is configured for supporting third rack assembly 126. In this regard, referring generally to FIGS. 4 through 8, dishwasher 100 may include a slide assembly 220 that is slidably mounted to the mounting body 210 (e.g., as will be described in more detail below). A third rack 222 may be slidably mounted to the slide assembly 220 using a plurality of rack rollers 224 and retention clips 226 positioned on opposite sides of slide assembly 220. A forward end of slide assembly 220 may include a retention arm 228 that engages the forward rack roller 224 to prevent third rack 222 from sliding off of slide assembly 220. In addition to sliding motion between third rack 222 and slide assembly 220, slide assembly 220 may itself slide or roll along mounting body 210 to increase the extension of third rack 222 outside of wash chamber 106 in the open position.

Notably, conventional dishwashers include slide assemblies that are slidably mounted to a mounting body through a small pin that extends substantially along the lateral direction L. Notably, this pin is commonly a failure mode of third rack assemblies. In this regard, the weight of the third rack commonly exerts bending or shearing forces that result in premature failure of the third rack assembly. Notably, due to the confined space within the upper region of wash chamber, enlarging the pin diameter is often not a feasible option. Aspects of the present subject matter are directed to structures for better supporting the loads exerted by third rack 122 for prolonged use of a third rack assembly 126 with minimal service or maintenance visits.

Referring now generally to FIGS. 7 through 12, rack mounting assembly 200 and mounting body 210 will be described in more detail according to exemplary embodiments of the present subject matter. Specifically, rack mounting assembly 200 may generally include one or more mounting posts 240 that extend from mounting body 210 substantially along the lateral direction L and are generally configured for receiving one or more rollers 242 on which slide assembly 220 may translate during operation. Although the illustrated embodiment includes two mounting posts 240 and two corresponding rollers 242, it should be appreciated that any suitable number, size, and position of mounting posts 240 and rollers 242 may be used while remaining within the scope of the present subject matter. One mounting post 240 and roller 242 assembly and their interaction are described below for brevity.

Rack mounting assembly 200 may further include a support flange 244 that extends from mounting body 210 and is spaced apart from mounting post 240 to define a support slot 246 therebetween. According to exemplary embodiments of the present subject matter, mounting body 210, mounting post 240, and support flange 244 are integrally formed as a single, integral, and monolithic peace. For example, these features may all be formed during a single injection molding process, e.g., using a suitable plastic material, such as injection molding grade Polybutylene Terephthalate (PBT), Nylon 6, high impact polystyrene (HIPS), Perfluoroalkoxy (PFA), Flourinated ethylene propylene (FEP), or acrylonitrile butadiene styrene (ABS). Alternatively, according to the exemplary embodiment, these components may be extruded (tubing), compression molded, e.g., using sheet molding compound (SMC) thermoset plastic or other thermoplastics. According still other embodiments, mounting body 210, mounting post 240, and support flange 244 may be formed from any other suitable rigid material.

As best shown in FIGS. 9 through 12, roller 242 generally includes a mounting sleeve 250 that is generally configured for engaging mounting post 240 and a roller surface 252 positioned at a distal end of mounting sleeve 250, such that roller surface 252 is cantilevered into wash chamber 106 for engaging slide assembly 220. As shown, mounting sleeve 250 generally defines a central aperture 254 that is configured for slidably receiving mounting post 240. In this manner, mounting sleeve 250 generally transfers forces from the load of third rack 222 onto mounting body 210 through mounting post 240. Although exemplary geometries of roller 242 are illustrated and described herein, it should be appreciated that variations and modifications may be made to roller 242 while remaining within the scope of the present subject matter.

Referring still to FIGS. 9 through 12, mounting sleeve 250 may define a rear lip 256 that is generally configured for receipt within support slot 246 when roller 242 is installed onto mounting body 210. In this regard, rear lip 256 engages support flange 244 and mounting post 240 in a manner that better transfers forces generated by third rack 222 to mounting body 210 and tub 104. The engagement of rear lip 256 within support slot 246 thereby reduces the likelihood of failure of mounting post or roller 242. According to the illustrated embodiment, mounting sleeve 250 is substantially cylindrical proximate rear lip 256 such that roller 242 may be rotated while rear lip 256 remains within support slot 246.

It should be appreciated that the thickness of rear lip 256 and support slot 246 may vary as needed to improve the interaction between roller 242 and mounting body 210. For example, rear lip 256 may define a lip thickness 258 (FIGS. 10 and 12) and support slot 246 may define a slot thickness 260. According to an exemplary embodiment, slot thickness 260 may be substantially equivalent to lip thickness 258. According to still other embodiments rear lip 256 may be slightly oversized such that there is an interference fit between mounting post 240 and support flange 244 when rear lip 256 is positioned within support slot 246. According still other embodiments, lip thickness 258 may be slightly less than slot thickness 260, such that roller 242 is capable of freely rotating on mounting post 240.

Notably, support flange 244 may generally be a discrete, localized feature or may extend around the entire circumference of mounting sleeve 250 as needed depending on the application. For example, according to the illustrated embodiments, support flange 244 comprises an upper support 270 positioned above mounting post 240 along the vertical direction V and a lower support 272 positioned below mounting post 240 along the vertical direction V. In this regard, because the force exerted by third rack 222 is typically downward along the vertical direction V, upper support 270 and lowers support 272 may best provide support against the bending moment and shear force exerted on mounting post 240. According to still other embodiments, support flange 244 may be substantially cylindrical, such that support slot 246 is a continuous annular void in which rear lip 256 may be securely received. It should be appreciated that support flange 244 may further include one or more support ribs 274 that provide structural support to support flange 244. Other support flanges and structures are possible and within the scope of the present subject matter.

It should be appreciated that the size and geometry of mounting post 240 and mounting sleeve 250 of roller 242 may very as needed to facilitate a strong structural relationship and mechanical engagement between these two components. For example, according to the illustrated embodiment shown in FIG. 10, mounting sleeve 250 may define a tapered region 276 adjacent rear lip 256 and mounting post 240 may define a complementary surface 278 to tapered region 276. By contrast, according to an alternative embodiment illustrated in FIGS. 11 and 12, mounting post 240 may be two-tiered and define a shoulder 280 where the diameter of mounting post 240 is narrowed, e.g., towards a distal end of mounting post 240.

In addition, according to exemplary embodiments of the present subject matter, mounting post 240 may define a post length 282 measured along the lateral direction L and mounting sleeve 250 may define a sleeve length 284 measured along the lateral direction L. According to exemplary embodiments, post length 282 may be greater than half, greater than three quarters, greater than 80%, greater than 90%, and/or less than 100% of sleeve length 284. In addition, according to exemplary embodiments, support slot 246 may define a slot depth 286 measured along the lateral direction L. According to an exemplary embodiment, a ratio between slot depth 286 and sleeve length 284 may be between about 0.1 and 0.9, between about 0.2 and 0.7, between about 0.25 and 0.5, or any other suitable ratio for supporting roller 242. It should be appreciated that these ratios are only exemplary and may vary according to alternative embodiments of the present subject matter.

Figure 9:
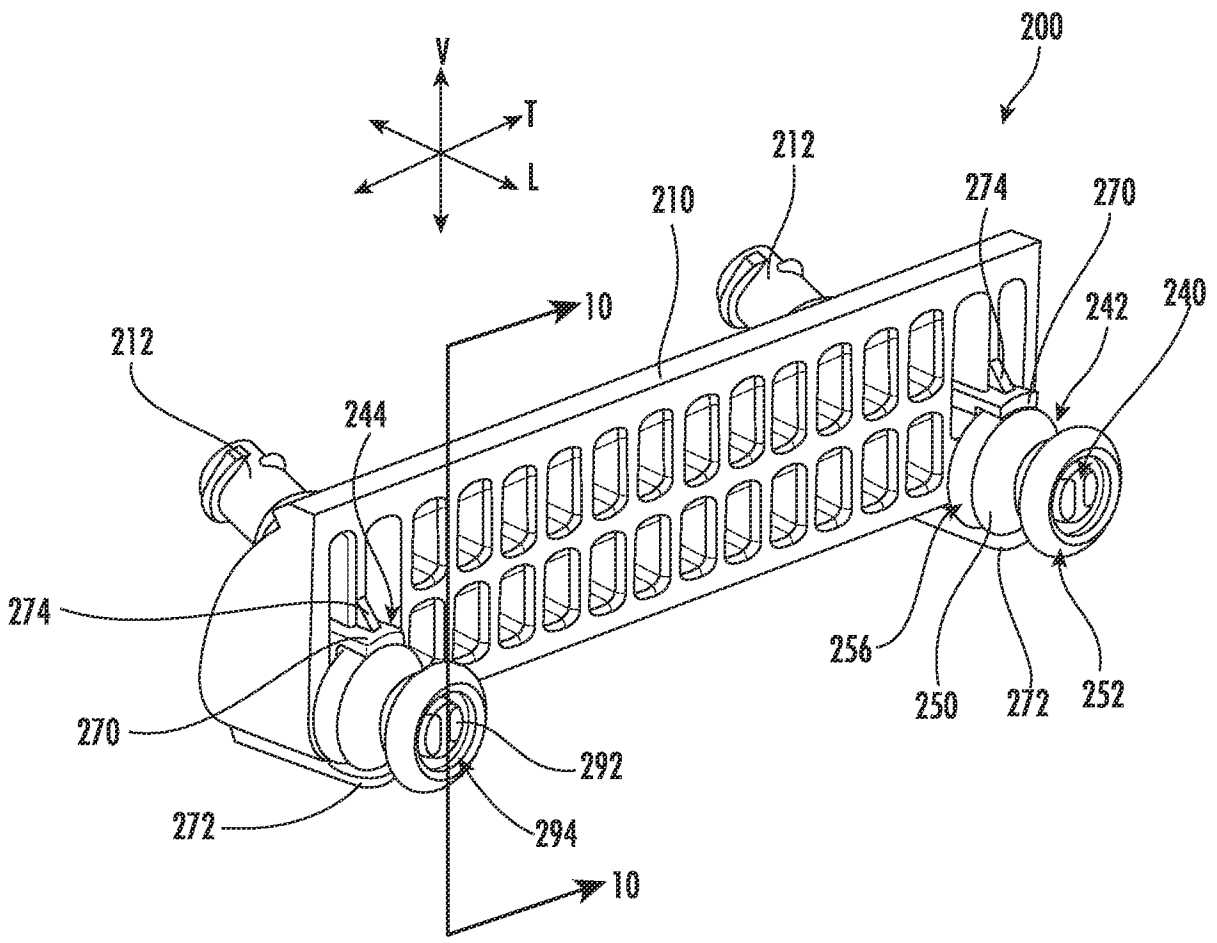
FIG. 9 provides a perspective view of the exemplary rack mounting assembly of FIG. 3 according to an exemplary embodiment of the present subject matter.
Figure 10:
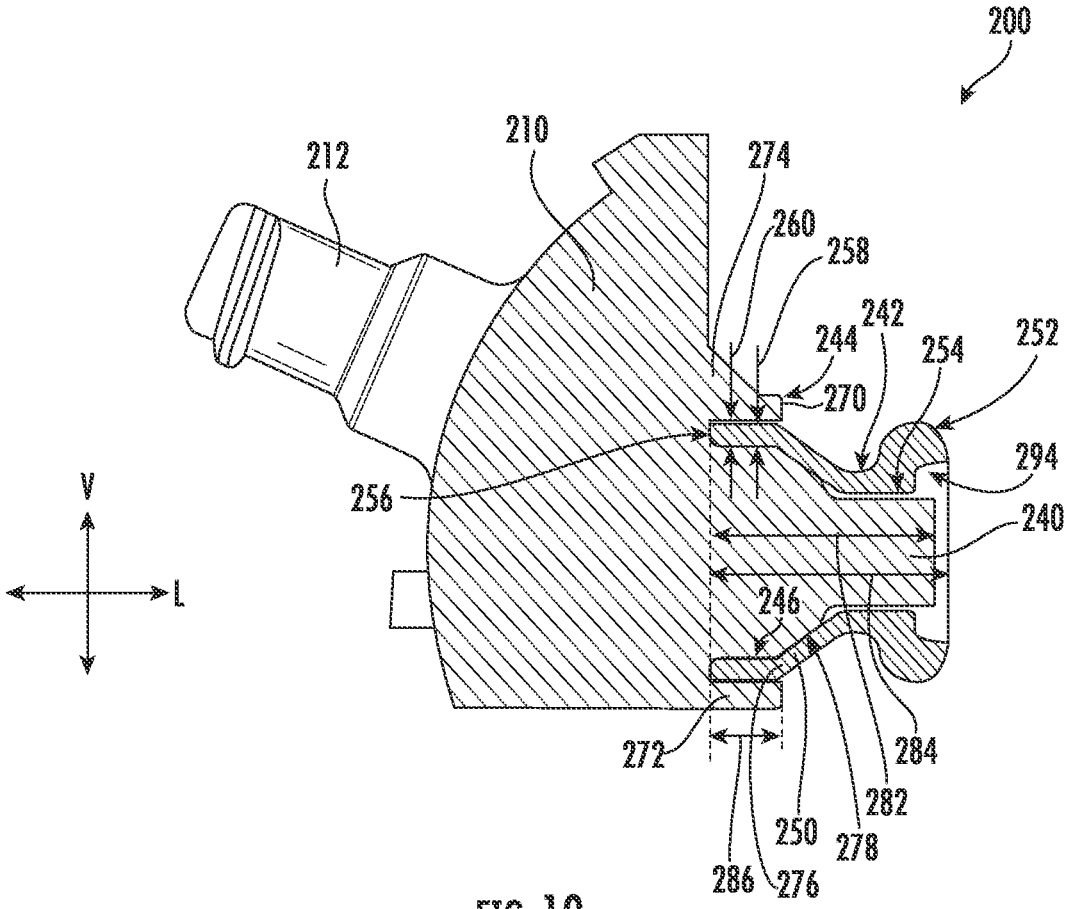
FIG. 10 provides a cross sectional view of the exemplary rack mounting assembly of FIG. 3, taken along Line 10-10 of FIG. 9.
Figure 11:
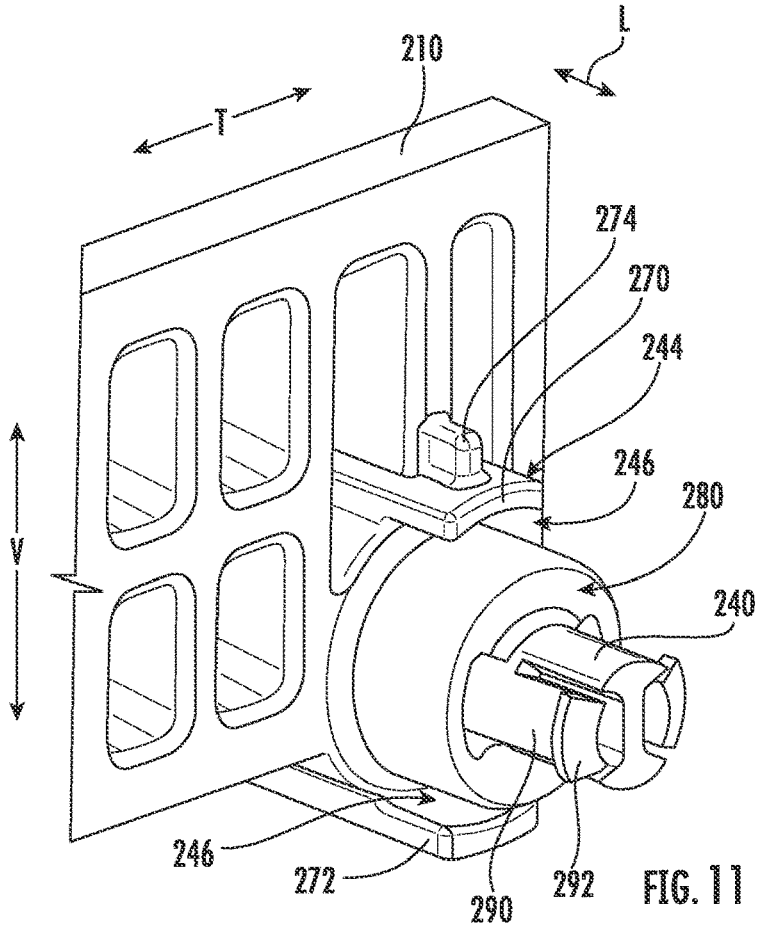
FIG. 11 provides a perspective view of a mounting post of the exemplary rack mounting assembly of FIG. 3 according to another exemplary embodiment of the present subject matter.
Figure 12:
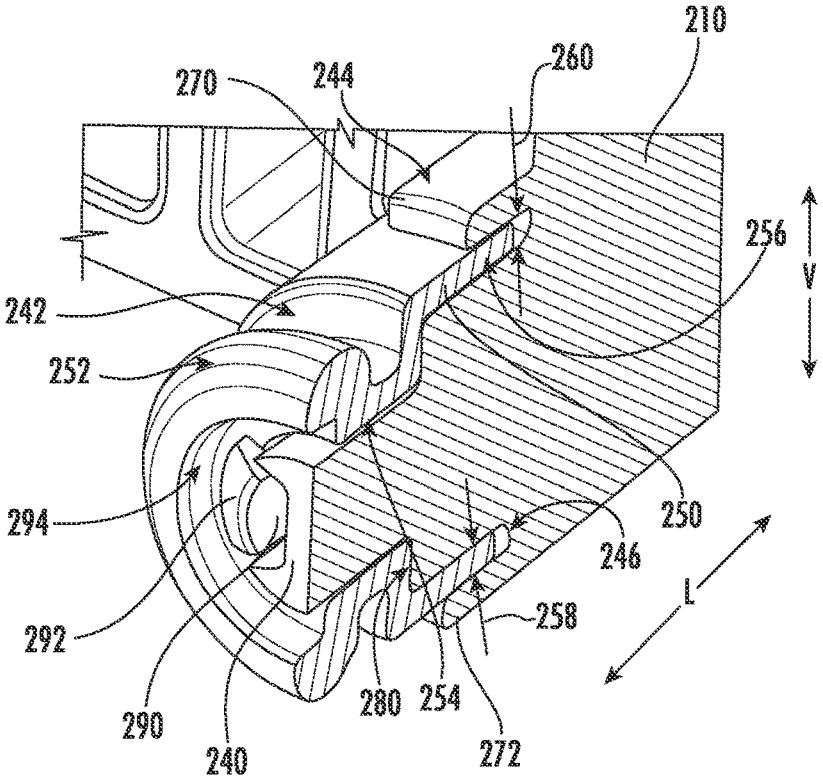
FIG. 12 provides a perspective, cross sectional view of the exemplary rack mounting assembly of FIG. 3 according to another exemplary embodiment of the present subject matter.

As best shown in FIGS. 9 and 11-12, mounting post 240 and roller 242 may further define features for securing roller 242 onto mounting post 240. In this regard, according to the illustrated embodiment, mounting post 240 may include or define one or more resilient elements 290 that extend away from mounting body 210 and have a locking protrusion 292 that extends outward along the radial direction relative to mounting post 240. In addition, roller 242 may define a locking recess 294 positioned at a distal end of mounting sleeve 250. As mounting sleeve 250 is inserted onto mounting post 240, resilient elements 290 are deflected inward until roller 242 is positioned such that rear lip 256 is fully seated within support slot 246. At this point, locking protrusions 292 clear mounting sleeve 250 and snap into locking recess 294 to prevent removal of roller 242 from mounting post 240. It should be appreciated that other suitable mechanisms for locking roller 242 to mounting post 240 are possible and within the scope of the present subject matter.

It should be appreciated that rack mounting assembly 200 is described herein only for the purpose of explaining aspects of the present subject matter. Modifications and variations may be made to rack mounting assembly 200 while remaining within the scope of the present subject matter. For example, the size, configuration, position, and operation of mounting body 210 may vary or be adjusted to control the interaction with tub 104 while remaining within the scope of the present subject matter. In addition, mounting post 240, roller 242, and support flange 244 may vary in geometry and construction without departing from the scope of the present subject matter. Rack mounting assembly 200 described herein provides for an easy assembly process for a third rack assembly along with improved reliability and support of a third rack. Other configurations and benefits will be apparent to those of skill in the art.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance defining a vertical, a lateral, and a transverse direction, the dishwasher appliance comprising:

a tub defining a wash chamber for receipt of articles for washing;

a rack assembly slidably positioned within the wash chamber and configured for movement along the transverse direction; and a rack mounting assembly for supporting the rack assembly, the rack mounting assembly comprising:

a mounting body positioned inside the wash chamber and being secured to the tub;

a mounting post extending from the mounting body along an axis of rotation;

a support flange extending from the mounting body and being spaced apart from the mounting post along a radial direction defined perpendicular to the axis of rotation to define a support slot; and a roller comprising a mounting sleeve defining a central aperture and a rear lip, the rear lip being received within the support slot when the roller is installed onto the mounting body such that the roller is rotatable about the axis of rotation.

2. The dishwasher appliance of claim 1, wherein the mounting sleeve is cylindrical proximate the rear lip.

3. The dishwasher appliance of claim 1, wherein the support flange comprises:

an upper support positioned above the mounting post; and a lower support positioned below the mounting post.

4. The dishwasher appliance of claim 1, wherein the mounting post and the support flange are cylindrical such that the support slot defined therebetween is annular.

5. The dishwasher appliance of claim 1, wherein the support slot defines a slot thickness that is substantially equivalent to a lip thickness of the rear lip.

6. The dishwasher appliance of claim 1, wherein rear lip creates an interference fit between the mounting post and the support flange when the rear lip is positioned within the support slot.

7. The dishwasher appliance of claim 1, wherein the mounting post defines a post length and the mounting sleeve defines a sleeve length, wherein the post length is greater than half the sleeve length.

8. The dishwasher appliance of claim 7, wherein the post length is greater than 75% of the sleeve length.

9. The dishwasher appliance of claim 7, wherein the support slot defines a slot depth, and wherein a ratio of the slot depth to the sleeve length is between about 0.25 and 0.5.

10. The dishwasher appliance of claim 1, wherein the mounting sleeve defines a tapered region adjacent the rear lip and the mounting post defines a complementary surface to the tapered region.

11. The dishwasher appliance of claim 1, wherein the mounting post comprises a resilient element having a locking protrusion and the roller defines a locking recess, wherein the resilient element is deflected as the roller is slides onto the mounting post until the locking protrusion clears the mounting sleeve and is seated in the locking recess to lock the roller in place.

12. The dishwasher appliance of claim 1, further comprising a support rib positioned behind the support flange relative to the support slot.

13. The dishwasher appliance of claim 1, wherein the roller defines a roller surface at a distal end of the mounting sleeve opposite the rear lip.

14. The dishwasher appliance of claim 1, wherein the mounting body, the mounting post, and the support flange are integrally formed as a single, integral piece.

15. A rack mounting assembly for supporting a rack assembly within a tub of a dishwasher appliance, the tub defining a wash chamber for receipt of articles for washing and a plurality of apertures, the rack mounting assembly comprising:

a mounting body positioned inside the wash chamber and being secured to the tub;

a mounting post extending from the mounting body along an axis of rotation;

a support flange extending from the mounting body and being spaced apart from the mounting post along a radial direction defined perpendicular to the axis of rotation to define a support slot; and a roller comprising a mounting sleeve defining a central aperture and a rear lip, the rear lip being received within the support slot when the roller is installed onto the mounting body such that the roller is rotatable about the axis of rotation.

16. The rack mounting assembly of claim 15, wherein the support flange comprises:

an upper support positioned above the mounting post; and a lower support positioned below the mounting post.

17. The rack mounting assembly of claim 15, wherein the support slot defines a slot thickness that is substantially equivalent to a lip thickness of the rear lip.

18. The rack mounting assembly of claim 15, wherein the mounting post defines a post length and the mounting sleeve defines a sleeve length, wherein the post length is greater than half the sleeve length.

19. The rack mounting assembly of claim 18, wherein the support slot defines a slot depth, and wherein a ratio of the slot depth to the sleeve length is between about 0.25 and 0.5.

20. The rack mounting assembly of claim 15, wherein the mounting post comprises a resilient element having a locking protrusion and the roller defines a locking recess, wherein the resilient element is deflected as the roller is slides onto the mounting post until the locking protrusion clears the mounting sleeve and is seated in the locking recess to lock the roller in place.

* * * * *